US006880919B2

(12) United States Patent
Min et al.

(10) Patent No.: US 6,880,919 B2
(45) Date of Patent: Apr. 19, 2005

(54) INK-JET PRINTHEAD AND METHOD OF MANUFACTURING THE SAME

(75) Inventors: Jae-sik Min, Gyeonggi-do (KR); Seo-hyun Cho, Gyeonggi-do (KR); Byung-ha Park, Gyeonggi-do (KR); Myung-jong Kwon, Seoul (KR); Kyong-il Kim, Gyeonggi-do (KR); Yong-shik Park, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/404,423

(22) Filed: Apr. 2, 2003

(65) Prior Publication Data

US 2003/0210299 A1 Nov. 13, 2003

(30) Foreign Application Priority Data

Apr. 2, 2002 (KR) ..... 10-2002-0018017

(51) Int. Cl.[7] ..... B41J 2/05
(52) U.S. Cl. ..... 347/63
(58) Field of Search ..... 347/20, 50, 54, 347/56, 61, 63, 64, 44, 45, 47, 203, 204; 430/320

(56) References Cited

U.S. PATENT DOCUMENTS 4,275,290 A * 6/1981 Cielo et al. ..... 347/61
5,880,759 A * 3/1999 Silverbrook ..... 347/55
6,019,457 A * 2/2000 Silverbrook ..... 347/65
6,162,589 A * 12/2000 Chen et al. ..... 430/320
6,412,918 B1 * 7/2002 Chen et al. ..... 347/56
6,666,546 B1 * 12/2003 Buswell et al. ..... 347/65

* cited by examiner

*Primary Examiner*—Stephen D. Meier
*Assistant Examiner*—An H Do
(74) *Attorney, Agent, or Firm*—Staas & Halsey LLP

(57) ABSTRACT

An ink-jet printhead includes a substrate on which an ink chamber is formed, and a nozzle plate to cover the ink chamber, having a nozzle through which ink droplets are ejected from the ink chamber, and formed of a stack of a multi-layer insulating layer. The ink-jet printhead also includes a heater buried in the nozzle plate to surround the nozzle, an interconnection layer buried in the nozzle plate to electrically connect to the heater, and a coating layer formed of photoresist on the nozzle plate and having a through hole-type droplet guide connected to the nozzle of the nozzle plate. The droplet guide is formed through the coating layer, which has a sufficient thickness, and enables a meniscus of ink to be rapidly restored and stabilized, and ink droplets to be ejected at a high speed and high frequency. Also, the ink-jet printhead has improved resistance to abrasion and chemicals.

13 Claims, 9 Drawing Sheets

INK-JET PRINTHEAD AND METHOD OF MANUFACTURING THE SAME

CROSS-REFERENCE TO RELATED APPLICATION

This application claims the priority of Korean Patent Application No. 2002-18017, filed on Apr. 2, 2002, in the Korean Intellectual Property Office, the disclosure of which is incorporated herein by reference.

BACKGROUND OF THE INVENTION

1. Field of the Invention

The present invention relates to a method of manufacturing an ink-jet printhead, and more particularly, to a method of improving a shape of a nozzle and effectively anti-wetting a surface of a nozzle plate while manufacturing an ink-jet printhead.

2. Description of the Related Art

Ink-jet printheads may eject ink by using an electro-thermal transducer which generates bubbles in the ink with a heat source, or by using an electro-mechanical transducer, which causes a volume variation of the ink by deformation of a piezoelectric device.

An ink ejection mechanism includes a top-shooting ink ejection mechanism, a side-shooting ink ejection mechanism, and a back-shooting ink ejection mechanism depending on a growth direction of bubbles and an ejection direction of ink droplets. The top-shooting ink ejection mechanism has a structure in which the growth direction of bubbles is identical with the ejection direction of ink droplets. The side-shooting ink ejection mechanism has a structure in which the growth direction of bubbles is perpendicular to the ejection direction of ink droplets. The back-shooting ink ejection mechanism has a structure in which the growth direction of bubbles is opposite to the ejection direction of ink droplets.

Ink-jet printheads having the above-described structures include a nozzle plate having a nozzle (orifice) through which ink droplets are ejected. The nozzle plate is directly opposite to paper and has several factors which may affect the ejection of ink droplets through the nozzle. The most important factor is a thickness and shape of the nozzle. One of the factors is a hydrophobic property of a surface of the nozzle plate. When the thickness of the nozzle is small or a section thereof has a radial shape, and the hydrophobic property of the surface of the nozzle plate is small (that is, when the nozzle plate is hydrophilic), some of the ink ejected though the nozzle soaks into the surface of the nozzle plate such that the surface of the nozzle plate is contaminated, and a size, direction, and speed of the ejected ink droplets are not constant. In order to solve these problems, the thickness of the nozzle is increased to at least over 10 $\mu$m, and a section thereof has a tapered shape. Also, a coating layer to perform anti-wetting is formed on the surface of the nozzle plate.

FIG. 1 is a schematic cross-sectional view of an ink-jet printhead 10 having the back-shooting ink ejection mechanism in which a nozzle plate is anti-wetted. Referring to FIG. 1, a hemispherical ink chamber 14 is formed in a center of a top surface of a substrate 11, a rectangular channel-type manifold 17 is formed under the hemispherical ink chamber 14, and the ink chamber 14 and the manifold 17 are communicated with each other via an ink passage 16. A multi-layer nozzle plate 12 is formed on the top surface of the substrate 11. The nozzle plate 12 is a membrane formed by several different layers stacked on the substrate 11, and includes a nozzle (or orifice) 18 formed in a center of the ink chamber 14, and a bubble guide 18*a* to extend into the ink chamber 14 around the nozzle 18. The nozzle plate 12 includes a lower insulating layer 12*a*, an intermediate insulating layer 12*b*, and an upper insulating layer 12*c*. A heater 13 which surrounds the nozzle 18 is formed between the lower insulating layer 12*a* and the intermediate insulating layer 12*b*, and an interconnection layer 15 to be connected to the heater 13 is formed between the intermediate insulating layer 12*b* and the upper insulating layer 12*c*. A pad 22 is also connected between the intermediate insulating layer 126 and the upper insulating layer 12*c*.

In the above-described structure, the upper insulating layer 12*c* is formed by a stack of two or more layers, and a hydrophobic coating layer 19 is formed on the upper insulating layer 12*c*. The hydrophobic coating layer 19 should be formed at least on a surface around the nozzle 18. Here, the hydrophobic coating layer 19 is formed of metal such as nickel (Ni), gold (Au), palladium (Pd) or tantalum (Ta), perfluoronated alkane and silane compounds with a high hydrophobic property such as fluoronated carbon (FC), F-Silane, or diamond-like carbon (DLC). The hydrophobic coating layer 19 may be formed using a wet deposition method such as spray coating or spin coating, or may be formed using a dry deposition method such as PECVD or sputtering. The hydrophobic coating layer 19 is formed in a state in which the nozzle 18, the bubble guide 18*a*, the ink chamber 14, the manifold 17, and the ink passage 16 have been already formed. While the hydrophobic coating layer 19 is formed, a hydrophobic material permeates into the ink chamber 14 through the nozzle 18 such that a hydrophobic material layer 19' is formed on an entire or partial surface of the ink chamber 14, and may also be, in a worse case scenario, formed on an inner wall of the ink passage 16 connected to the manifold 17. Since the hydrophobic material typically rejects ink, the ink may not be smoothly supplied to the ink chamber 14, and the ink chamber 14 may not be totally filled. Moreover, if the hydrophobic material layer 19' is formed inside the bubble guide 18*a*, this poorly affects movement of a meniscus 14*a* of the ink such that good quality ink droplets are not ejected at high speed. Thus, the hydrophobic material is formed on the surface of the nozzle plate 12, and the hydrophobic material layer 19', which is formed in the ink chamber 14 and the ink passage 16, is removed by a subsequent etch process (i.e., an $O_2$ plasma etch process). However, when the hydrophobic material in the ink chamber 14 is removed by the $O_2$ plasma etch process, the nozzle plate 12, and in particular, the hydrophobic coating layer 19 formed on the surface of the nozzle plate 12, may be overexposed to $O_2$ plasma and thus, damaged greatly.

Since the above-mentioned conventional ink-jet printhead has a back-shooting ink ejection mechanism in which the heater 13 is provided to the nozzle plate 12 having a small thickness, and the growth direction of bubbles is opposite to the ejection direction of ink droplets, the bubble guide 18*a* formed of tetraethoxysilane (TEOS) should be provided to a nozzle so that an expansion pressure is effectively transferred to ink droplets. In the absence of the bubble guide 18*a*, a pressure generated by bubbles cannot be sufficiently transferred to the nozzle and thus, ink droplets cannot be stably and rapidly ejected. If the nozzle plate 12 does not have a sufficient thickness, it is essential to form the bubble guide 18*a* on the nozzle. Preferably, the bubble guide 18*a* has a height of 30 microns. However, due to limitations of reactive ion etch (RIE) and TEOS processes on Si, it is substantially difficult to form the bubble guide 18*a* with a height of more than 10 microns.

SUMMARY OF THE INVENTION

Accordingly, it is an aspect of the present invention to provide a method of manufacturing an ink-jet printhead in which a nozzle is manufactured and processed effectively by a simple process.

It is also an aspect of the present invention to provide a method of manufacturing an ink-jet printhead which has a high hydrophobic property, a high chemical resistant property, and a high abrasion resistant property, and includes a nozzle through which high quality ink droplets are ejected rapidly at a high speed.

Additional aspects and advantages of the invention will be set forth in part in the description which follows and, in part, will be obvious from the description, or may be learned by practice of the invention.

The foregoing and/or other aspects of the present invention are achieved by providing an ink-jet printhead including an ink chamber, a substrate on which the ink chamber is formed, and a nozzle plate to cover the ink chamber, having a nozzle through which ink droplets are ejected from the ink chamber, and formed of a multi-layer insulating layer. The ink-jet printhead also includes a heater buried in the nozzle plate to surround the nozzle, an interconnection layer buried in the nozzle plate to electrically connect to the heater, and a coating layer formed of photoresist on the nozzle plate and having a through hole-type droplet guide connected to the nozzle of the nozzle plate.

The foregoing and/or other aspects of the present invention are achieved by providing a method of manufacturing an ink-jet printhead including a substrate on which an ink chamber having a predetermined volume and an opening in a ceiling thereof is formed, a nozzle formed on the substrate to correspond to the opening of the ink chamber, a heater to surround the nozzle, an interconnection layer to electrically connect to the heater, and a nozzle plate having a stack formed of a multi-layer insulating layer which protects the nozzle, the heater, and the interconnection layer. The method includes forming the stack of the multi-layer insulating layer having a nozzle region corresponding to the ink chamber, the heater which is buried in the stack and surrounds the nozzle region, and the interconnection layer which is connected to the heater on the substrate having a portion where the ink chamber is to be formed, obtaining the nozzle plate formed on the substrate. The method also includes removing part of the multi-layer insulating layer corresponding to the nozzle region of the nozzle plate, and forming the nozzle which penetrates the nozzle plate. The method includes forming a photoresist layer on the nozzle plate to obtain a coating layer formed on the nozzle plate, and further removing photoresist from the photoresist layer in the nozzle and above the nozzle by a photolithography process including an exposure process and an etch process so that the nozzle of the nozzle plate extends through a droplet guide to form a through hole in the coating layer. The method includes injecting an isotropic wet etchant into the nozzle formed on the nozzle plate and the coating layer to form the ink chamber in an ink chamber region below the heater.

According to an aspect of the invention, the coating layer is formed of a negative-type photoresist.

According to an aspect of the invention, the coating layer is thicker than the nozzle plate.

According to another aspect of the invention, the droplet guide formed through the coating layer is a tapered droplet guide whose diameter gradually decreases in a direction in which ink droplets are ejected.

According to yet another aspect of the invention, the ink chamber is formed in a hemispherical shape, and an entrance of the nozzle formed through the nozzle plate is flush with a ceiling of the ink chamber.

According to an aspect of the invention, the coating layer is formed by a plating metal such as Ni.

BRIEF DESCRIPTION OF THE DRAWINGS

The above and/or other aspects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
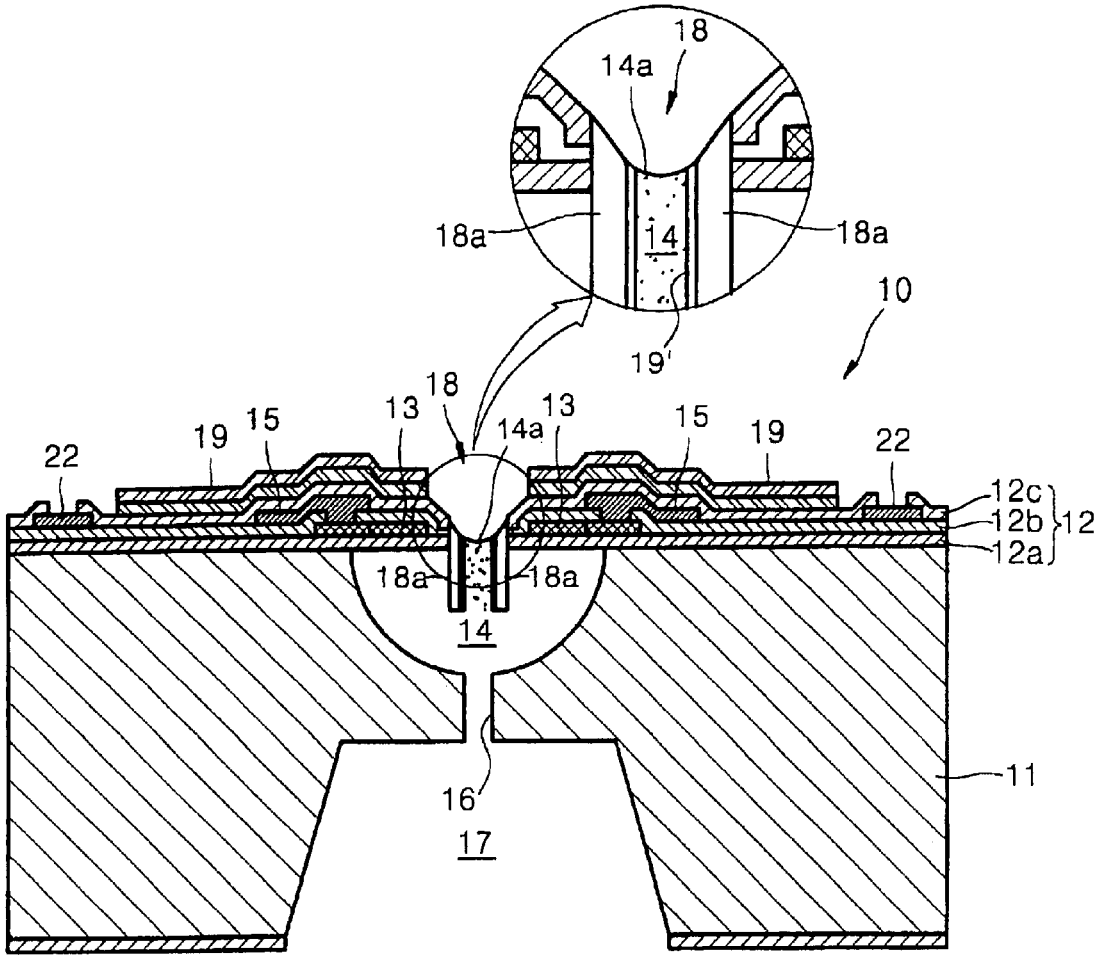
FIG. 1 (PRIOR ART)
FIG. 1 is a schematic cross-sectional view of an ink-jet printhead to show a method of forming a coating layer when a conventional ink-jet printhead is manufactured.

Reference will now be made in detail to the present preferred embodiments of the present invention, examples of which are illustrated in the accompanying drawings, wherein like reference numerals refer to like elements throughout.

An ink-jet printhead, according to an embodiment of the present invention, which will be described later with reference to FIG. 2A, has the following features. A coating layer is formed using photoresist on a nozzle plate. Preferably, the coating layer is three or more times thicker than the nozzle plate under the coating layer, and the photoresist is a negative-type photoresist. In addition, a through hole formed in the coating layer serves as a droplet guide to guide ink droplets ejected from the nozzle plate.

Figure 2A:
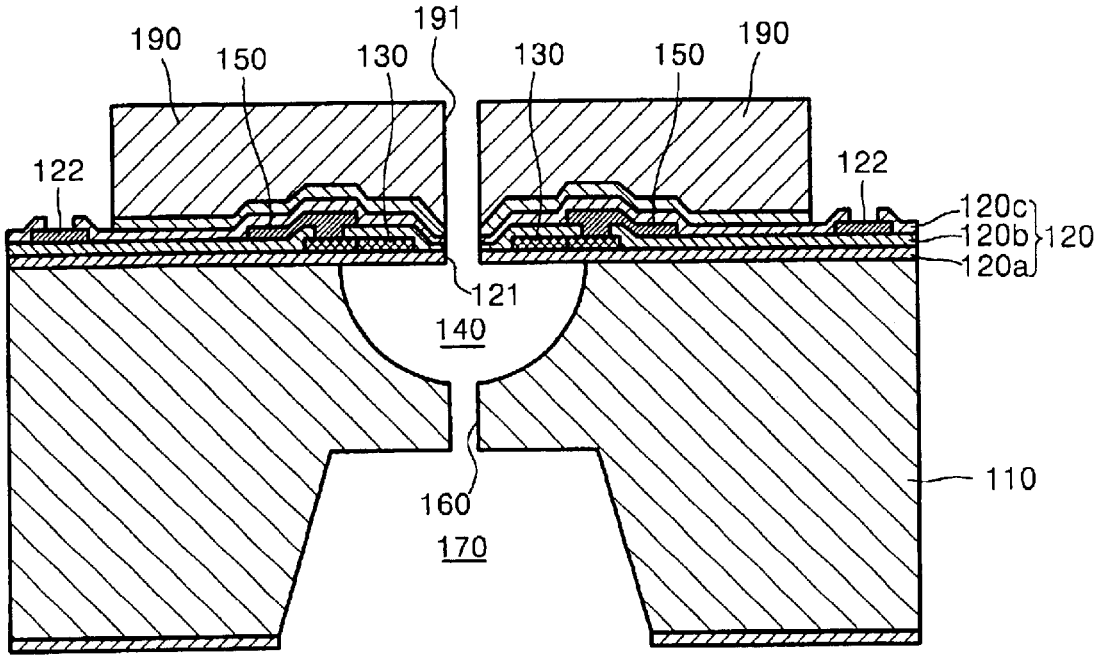
FIG. 2A is a schematic cross-sectional view illustrating an ink-jet printhead, according to an embodiment of the present invention.

As shown in FIG. 2A, there is no tube-type bubble guide formed inside the nozzle plate like the bubble guide 18*a* employed in the conventional ink-jet printhead shown in FIG. 1. Instead, an ink chamber is formed in a hemispherical shape, and entrance to a nozzle formed on the nozzle plate is flush with a ceiling of the ink chamber. The bubble guide, instead of being removed from the present invention, is replaced with a long cylindrical droplet guide formed on the coating layer. The droplet guide is separated from the ink chamber. The nozzle plate is formed of a multi-layer insulating layer and the coating layer formed on the insulating layer. Hereinafter, even though the coating layer is part of the nozzle plate, as a matter of convenience, a stack which includes the multi-layer insulating layer, is called the nozzle plate, and the coating layer will be described separately.

An ink-jet printhead 100 according to an embodiment of the present invention will now be briefly described with reference to FIG. 2A. Referring to FIG. 2A, a hemispherical ink chamber 140 is formed in a center of a top surface of a substrate 110. A rectangular channel-type manifold 170 is formed under the hemispherical ink chamber 140, and ink is supplied to the ink chamber 140 from the manifold 170 via an ink passage 160 formed on a bottom surface of the ink chamber 140. A nozzle plate 120 made up of a multi-layer insulating layer is formed on the top surface of the substrate 110 according to a structural feature of a back-shooting ink ejection mechanism. The nozzle plate 120 is a membrane formed by a stack of insulating layers sequentially formed on the surface of the substrate 110. The nozzle plate 120 includes a nozzle 121 formed in a center of the ink chamber 140. A coating layer 190 is formed using photoresist on the nozzle plate 120. A through hole is formed in the coating layer 190 connected to the nozzle 121, and guides an ejection of droplets. The nozzle 121 and the through hole substantially constitute one nozzle. In the present embodiment, the through hole is actually a part of the nozzle that extends through the coating layer and is used to guide the ejected droplets together with the nozzle 121 of the nozzle plate 120. Thus, to emphasize its function, the through hole is referred to as a droplet guide 191.

The nozzle plate 120 includes a first insulating layer 120*a*, a second insulating layer 120*b*, and a third insulating layer 120*c*. The nozzle plate 120 further includes a heater 130 formed between the first insulating layer 120*a* and the second insulating layer 120*b* to surround the nozzle 121. The heater 130 is formed adjacent to the nozzle 121 between the first insulating layer 120*a* and the second insulating layer 120*b*. An interconnection layer 150 connected to the heater 130 is formed between the second insulating layer 120*b* and the third insulating layer 120*c*. In the above structure, the third insulating layer 120*c* may be a single layer, but may also be formed of a plurality of insulating layers including a passivation layer (not shown).

Figure 2B:
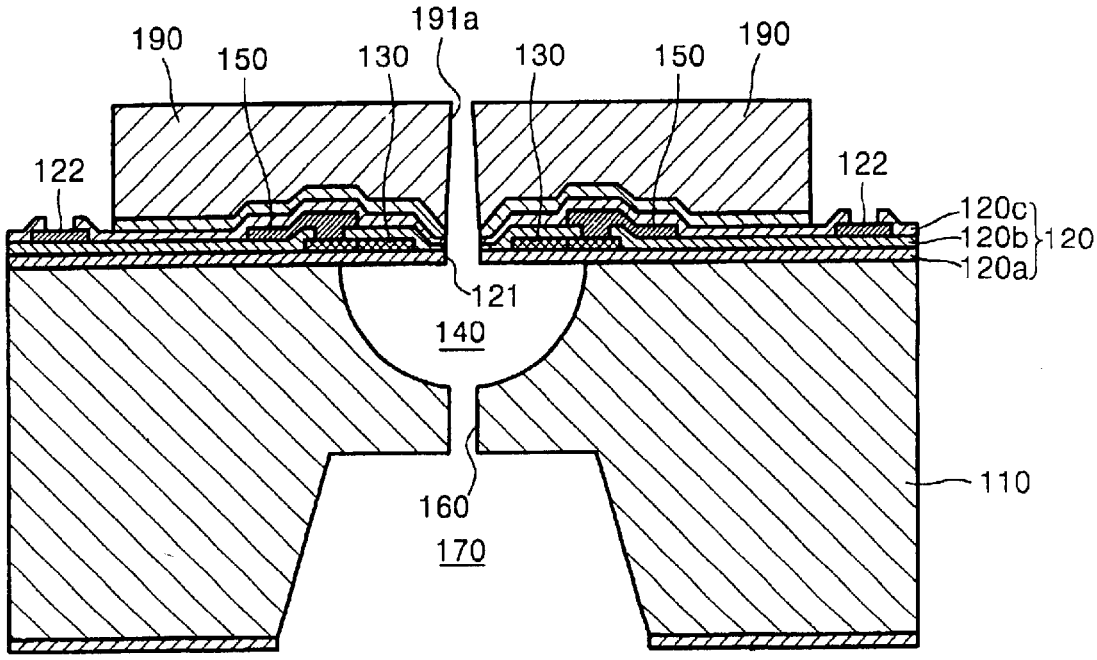
FIG. 2B is a schematic cross-sectional view illustrating an ink-jet printhead, according to another embodiment of the present invention.

The coating layer 190 is formed on the third insulating layer 120*c*. The coating layer 190 is formed of photoresist, and preferably a negative-type photoresist. Preferably, the coating layer 190 is thicker than the nozzle plate 120 formed of the first, second, and third insulating layers 120*a*, 120*b*, and 120*c*. When the coating layer 190 is formed of a light cured negative-type photoresist, exposure to ultraviolet rays while being used increases its mechanical intensity. As shown in FIG. 2B, the droplet guide 191 of the coating layer 190 may be formed to have a conical shape whose upper portion is narrower than its lower portion by proper treatment. This contributes to greatly improving an ejection property of ink droplets.

Hereinafter, a method of manufacturing an ink-jet printhead according to an embodiment of the present invention will be described in detail. Here, techniques of forming and patterning layers are the same well-known techniques employed in conventional methods of manufacturing an ink-jet printhead and thus, do not limit the scope of the present invention unless specifically described.

Figure 3A:
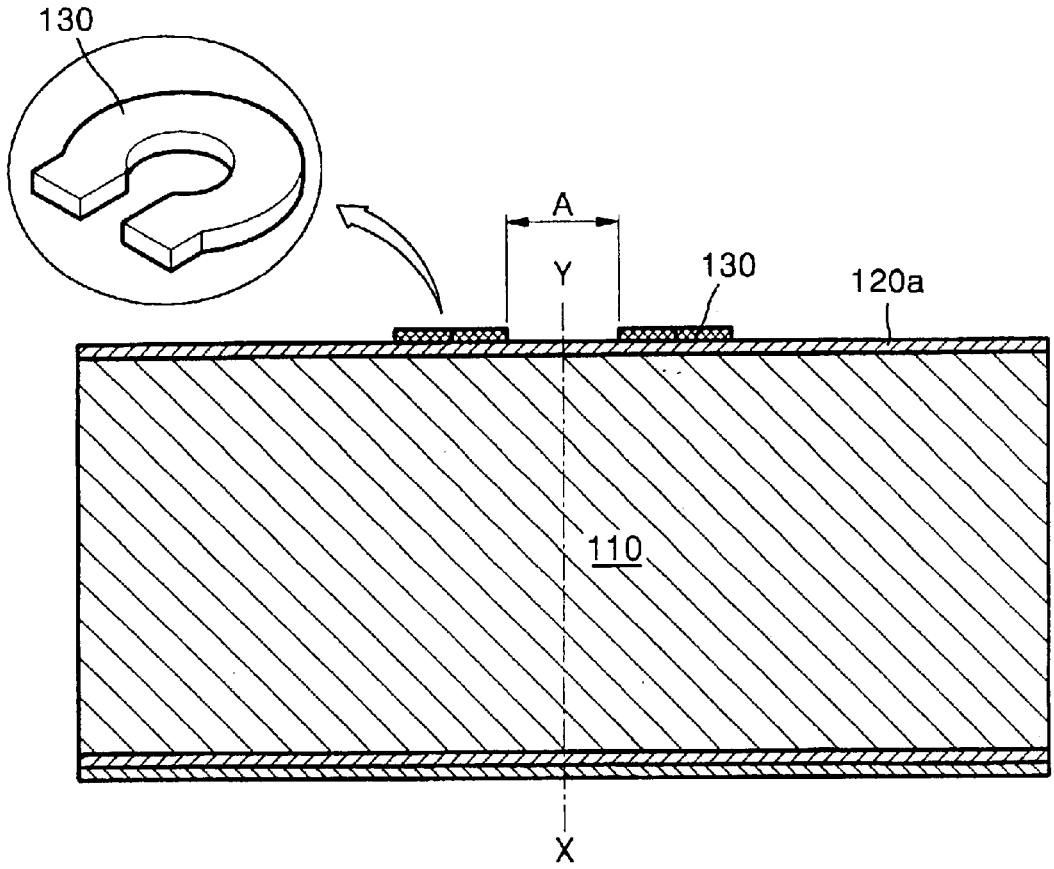
FIGS. 3A through 3M are process views illustrating a method of manufacturing an ink-jet printhead, according to the present invention.

First, a silicon oxide first insulating layer 120*a* is formed by PECVD on the surface of a substrate 110 such as an Si wafer, and then a ring-shaped or omega-shaped heater 130 is formed on the first insulating layer 120*a*, as shown in FIG. 3A. The heater 130 may be formed in various shapes which surround a center axis Y—Y of a region A with a diameter of about 20 microns where a nozzle is to be formed. The heater 130 is formed by depositing polysilicon, doping it with impurities, forming a mask, and patterning by a reactive ion etch (RIE) process.

Figure 3B:
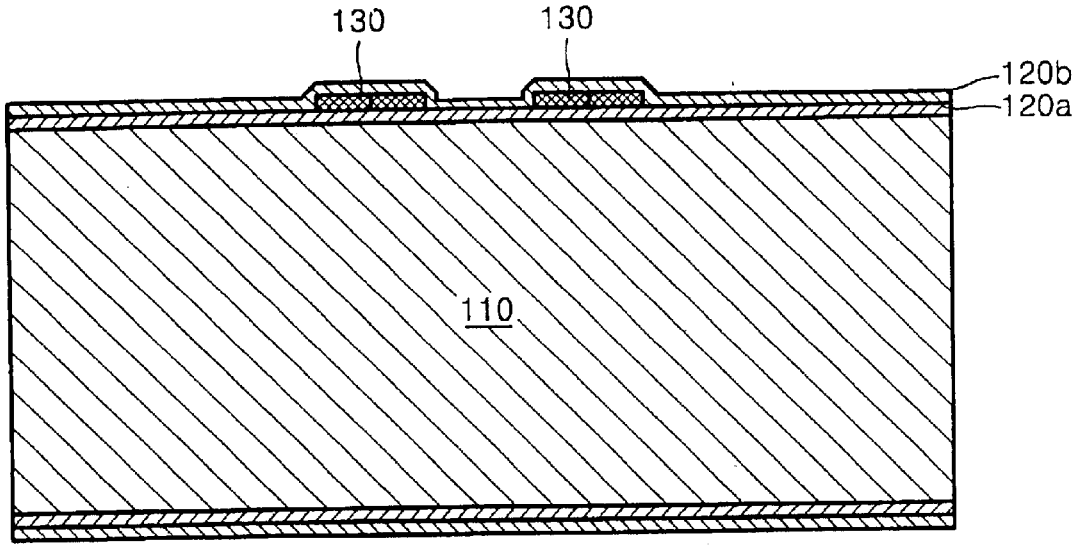
Figure 3C:
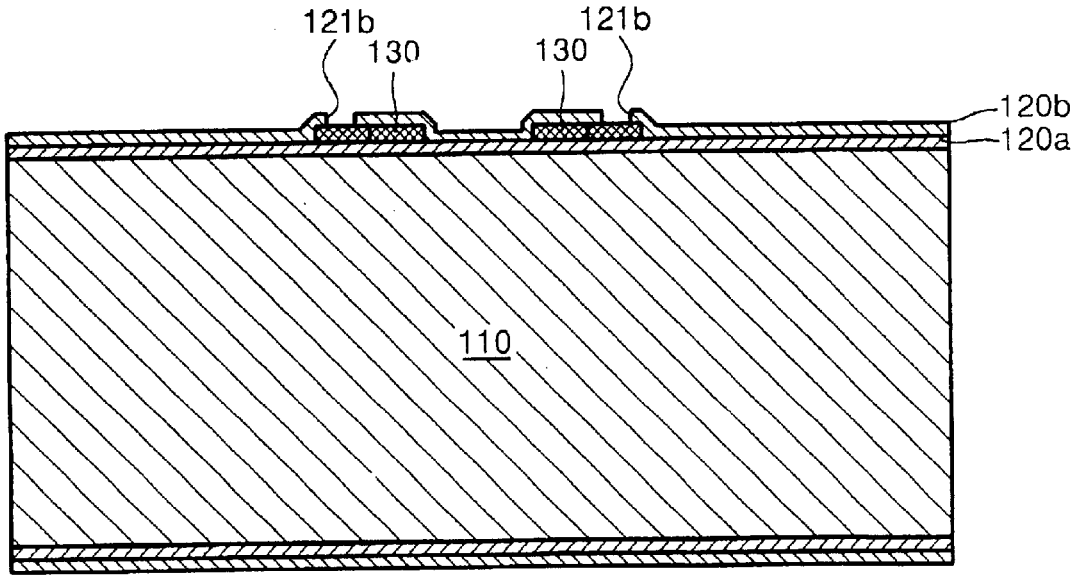

Next, the second insulating layer 120*b* formed of silicon nitride is formed by CVD on the top surface of the substrate 110, as shown in FIG. 3B. Then, a contact hole 121*b* used to electrically connect the heater 130 to a driving source (not shown) is formed by a photolithography process on the second insulting layer 120*b*, as shown in FIG. 3C.

Figure 3D:
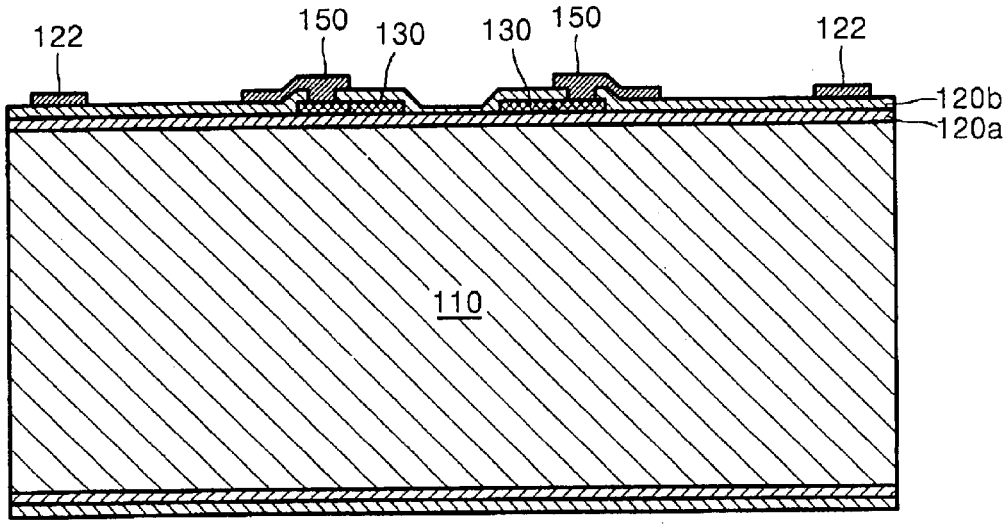

Subsequently, an interconnection layer 150 and a pad 122 connected to the interconnection layer 150 are formed on the second insulating layer 120*b*, as shown in FIG. 3D. The interconnection layer 150 and the pad 122 are formed by depositing aluminum or aluminum alloy using a sputtering apparatus, forming a mask, and patterning by a photolithography process including an etch process.

Figure 3E:
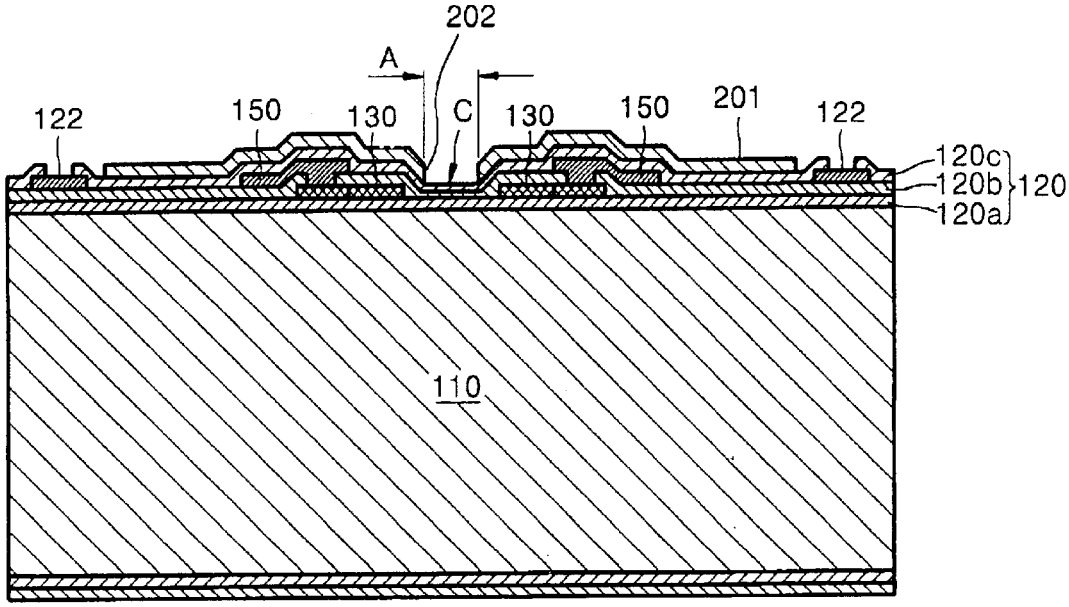

Next, a third insulating layer 120*c* is formed over the entire above-described structure, as shown in FIG. 3E. As a result, a depressed portion C having a sloping wall is formed on a region where the nozzle is to be formed. Preferably, the third insulating layer 120*c* is an inter-metal dielectric (IMD) layer. The third insulating layer 120*c* needs to have a predetermined thickness so as to protect the heater 130. An additional insulating layer formed of silicon oxide may be further formed by PECVD on the third insulating layer 120*c*. Here, a thickness of the nozzle plate 120 formed of the first, second, and third insulating layers 120*a*, 120*b*, and 120*c* is adjusted to about 10 microns.

Figure 3F:
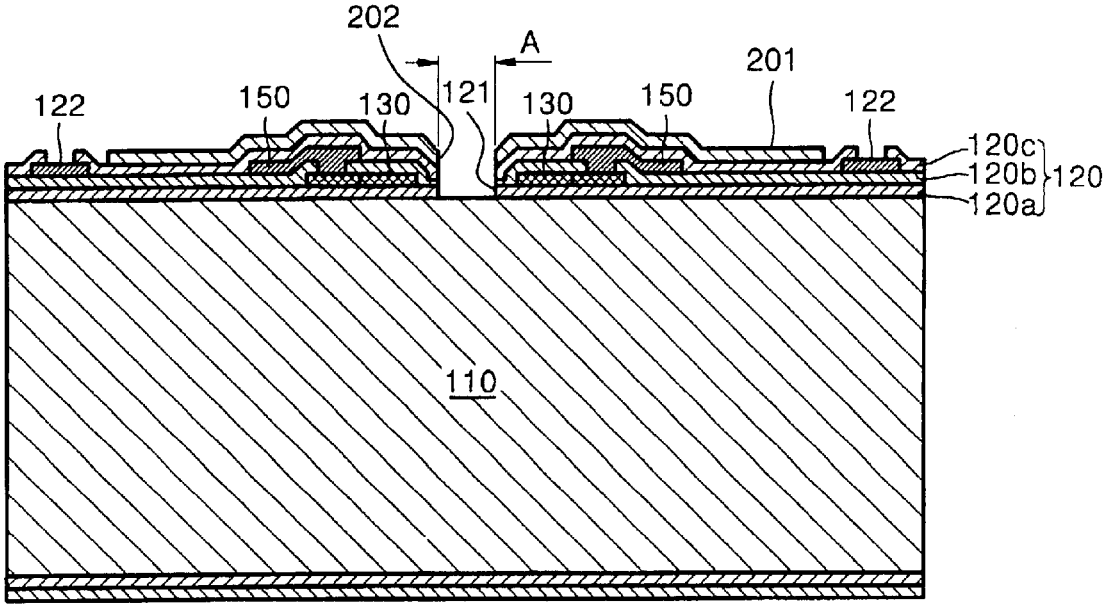

Subsequently, a photoresist mask layer 201 having a window 202 corresponding to the nozzle-forming region A is formed on the third insulating layer 120*c*. Then, the first, second, and third insulating layers 120*a*, 120*b*, and 120*c* in the nozzle-forming region A are removed by an RIE process so as to form the nozzle 121 having a diameter of about 20 microns, as shown in FIG. 3F.

Figure 3G:
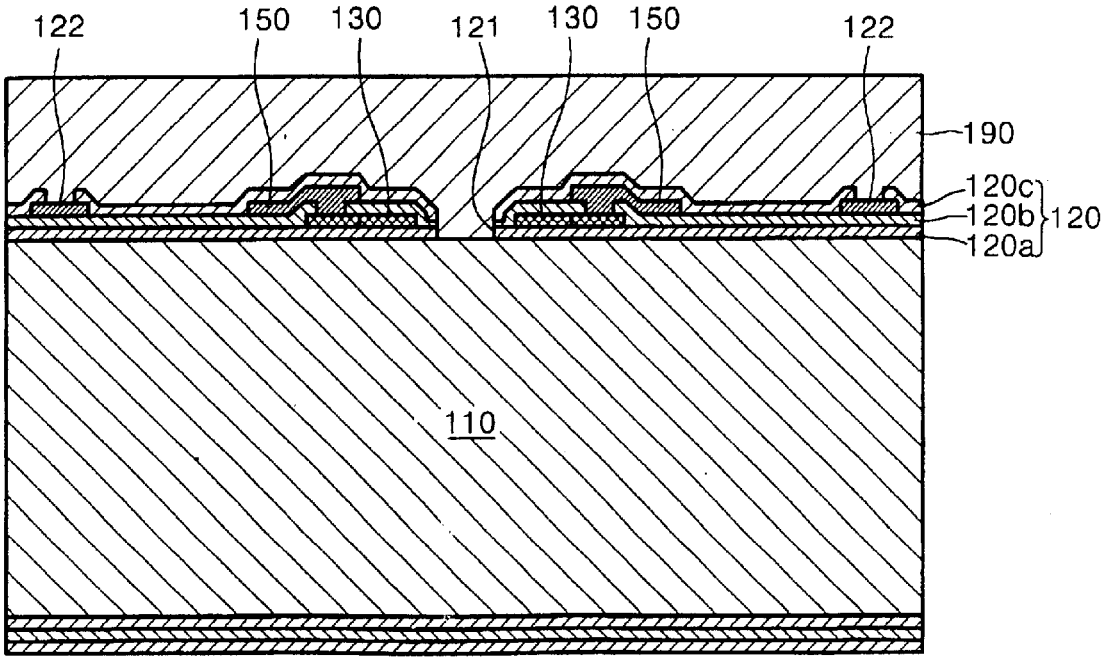

Next, a coating layer 190 is formed to a sufficient thickness, i.e., 30 microns or more, by spin coating a photoresist layer on the nozzle plate 120 formed of the first, second, and third insulating layers 120*a*, 120*b*, and 120*c*, as shown in FIG. 3G. Here, the coating layer 190 may be formed to an initial thickness that is greater than its intended final thickness. This may be needed to adjust exposure conditions to form the droplet guide which is described later. As is well known, the coating layer 190 may be adjusted to a desired thickness. Preferably, the coating layer 190 is three or more times thicker than the nozzle plate 120. When the mask layer 201 and the coating layer 190 are optically different, the mask layer 201 should be removed before forming the coating layer 190. FIG. 3G shows a state where the mask layer 201 has been removed. In this case, the coating layer 190 is preferably formed of the light cured negative-type photoresist. Su-8, PIMEL, polyimide-families, or polyamide may be used as this type of photoresist.

Figure 3H:
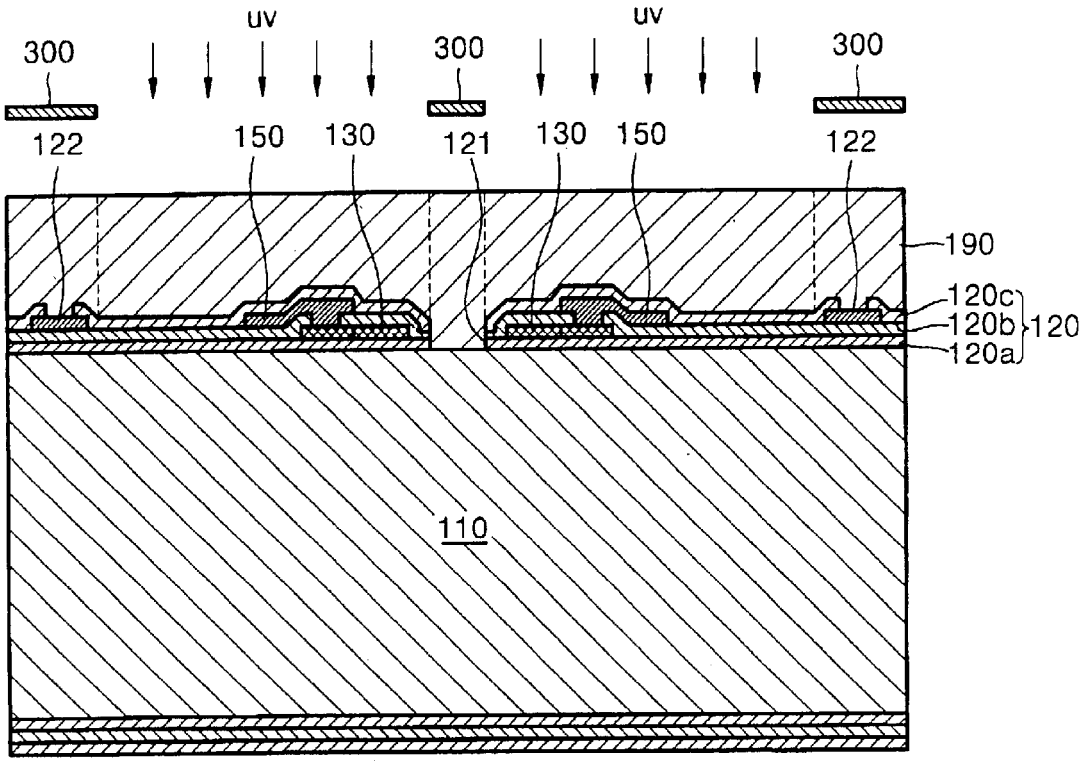

Subsequently, the coating layer 190 is exposed to ultraviolet rays (UV) using a mask 300, as shown in FIG. 3H. Here the negative-type photoresist undergoes light curing and a portion to be removed is covered by the mask 300 so as to prevent permeation by UV rays. However, when the coating layer 190 is formed of a positive-type photoresist, a portion not to be removed is covered by the mask 300.

Figure 3I:
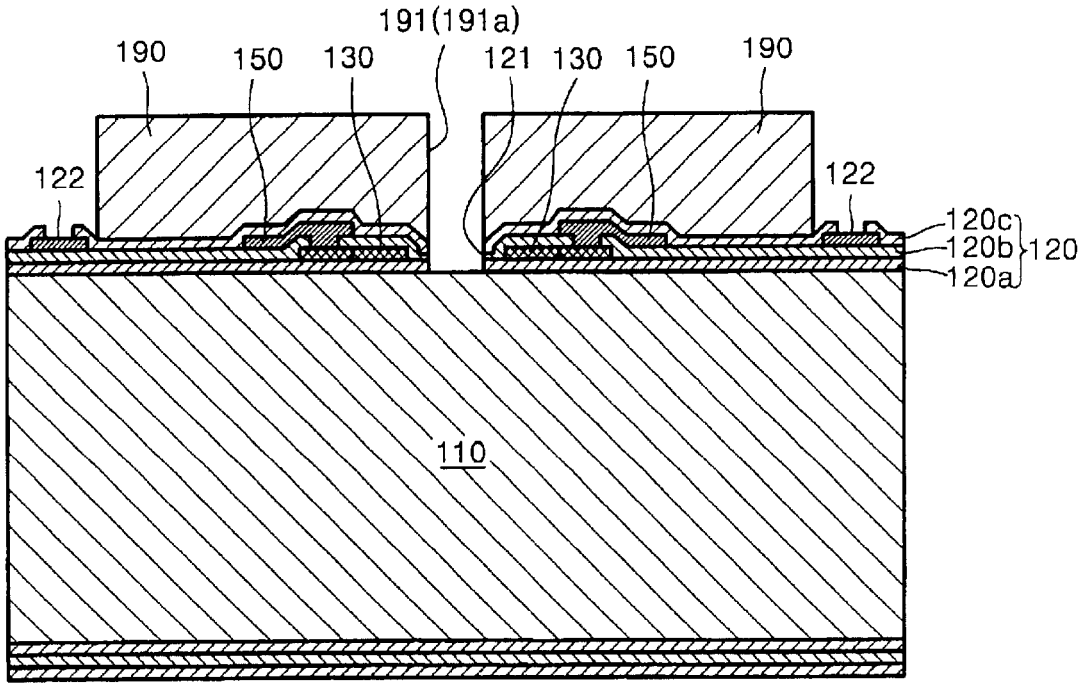

Next, the photoresist formed on the nozzle 121 and the pad 122 is removed using a wet etchant after an exposure process is completed, as shown in FIG. 3I. Thus, a cylindrical droplet guide 191 is formed and connected to the nozzle 121. Since UV absorption decreases from a surface to a bottom of the photoresist into which UV rays are transmitted, when the droplet guide 191 is formed by etching the photoresist using a developer, the photoresist is etched less and less from its deepest portion to its surface. If the photoresist is deliberately underexposed, a resulting gradient in an amount of photoresist etched by the developer leads to a formation of a conical droplet guide 191*a*. The conical droplet guide 191*a* is hydrodynamically advantageous when ejecting ink droplets. However, when the exposure process is performed sufficiently, the deepest portion of the photoresist is exposed sufficiently and thus, the cylindrical droplet guide 191 as shown in FIG. 2B is formed. In order to form the conical droplet guide 191*a* to have a preferable structure, exposure conditions, i.e., an intensity of the UV rays and an exposure time, are adjusted to control over-etching occurring at the deepest portion of the photoresist. Subsequently, the coating layer 190 is hard-baked to provide physical and chemical stability.

Figure 3J:
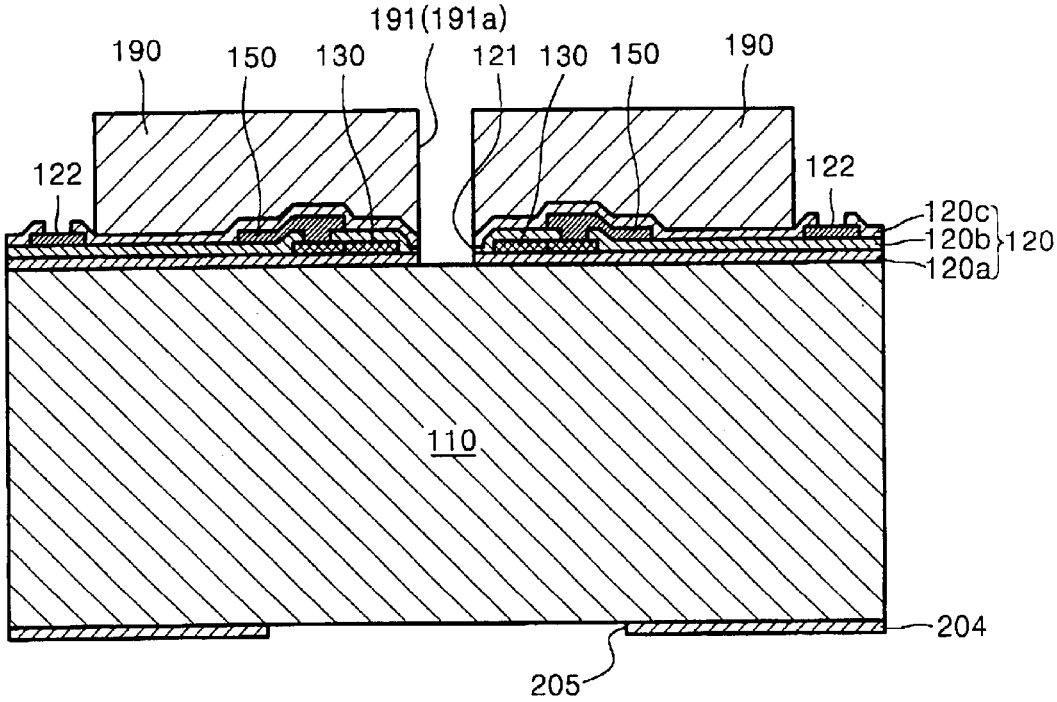

Next, thin layers formed by the above-performed process are polished on the bottom surface of the substrate 110, and then, a mask layer 204 having a window 205 to form a manifold having a width of about 500 microns is formed on the bottom surface of the substrate 110, as shown in FIG. 3J.

Figure 3K:
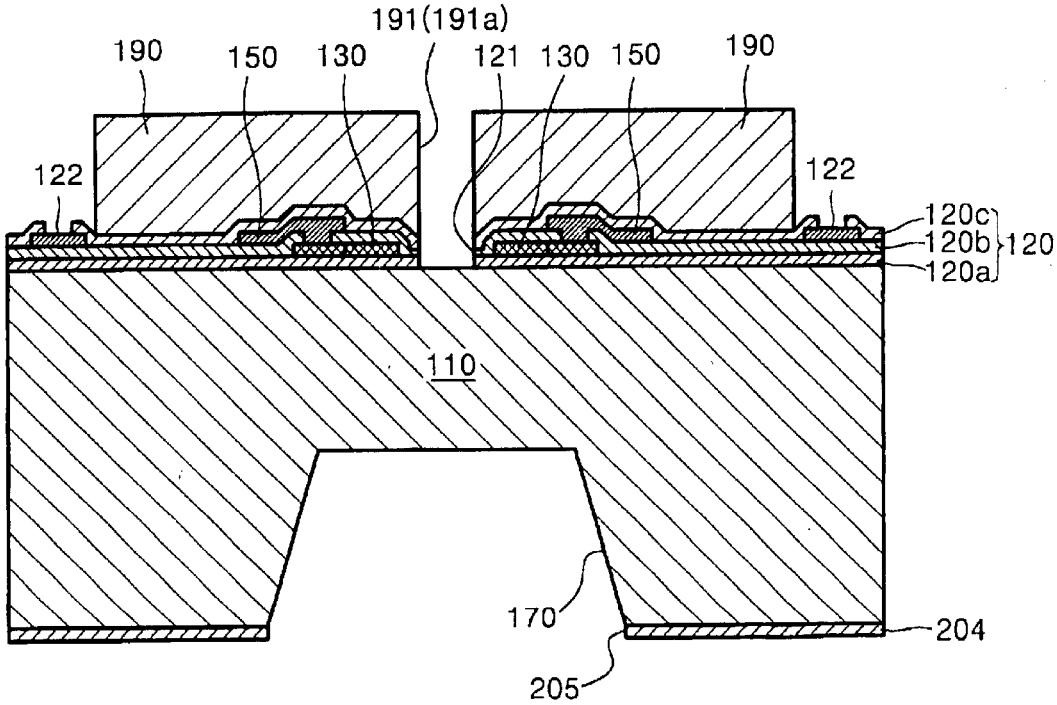

Subsequently, a portion of the substrate 110 exposed to the window 205 of the mask layer 204 is anisotropically etched using tetramethylammonium hydroxide (TMAH) to a predetermined thickness to form the manifold 170, as shown in FIG. 3K.

Figure 3L:
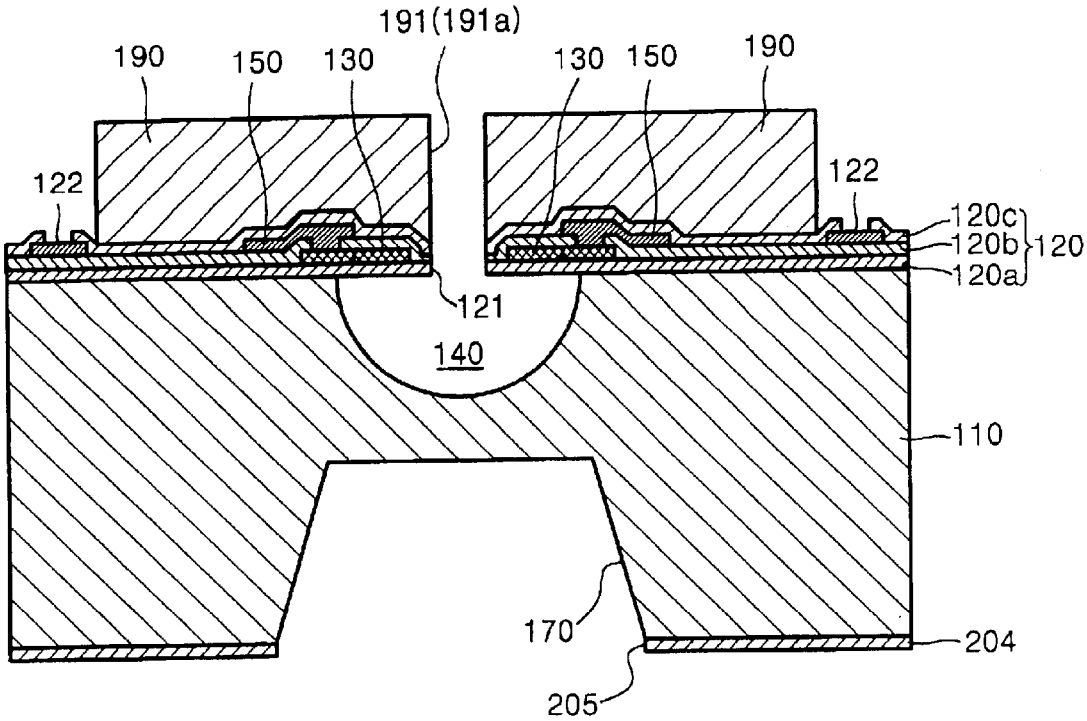

Next, an etching gas is supplied to the droplet guide 191 and the conical droplet guide 191*a* using a dry etching apparatus, i.e., an $XeF_2$ etching apparatus, to form the hemispherical ink chamber 140 having a diameter of about 30–40 microns, as shown in FIG. 3L.

Figure 3M:
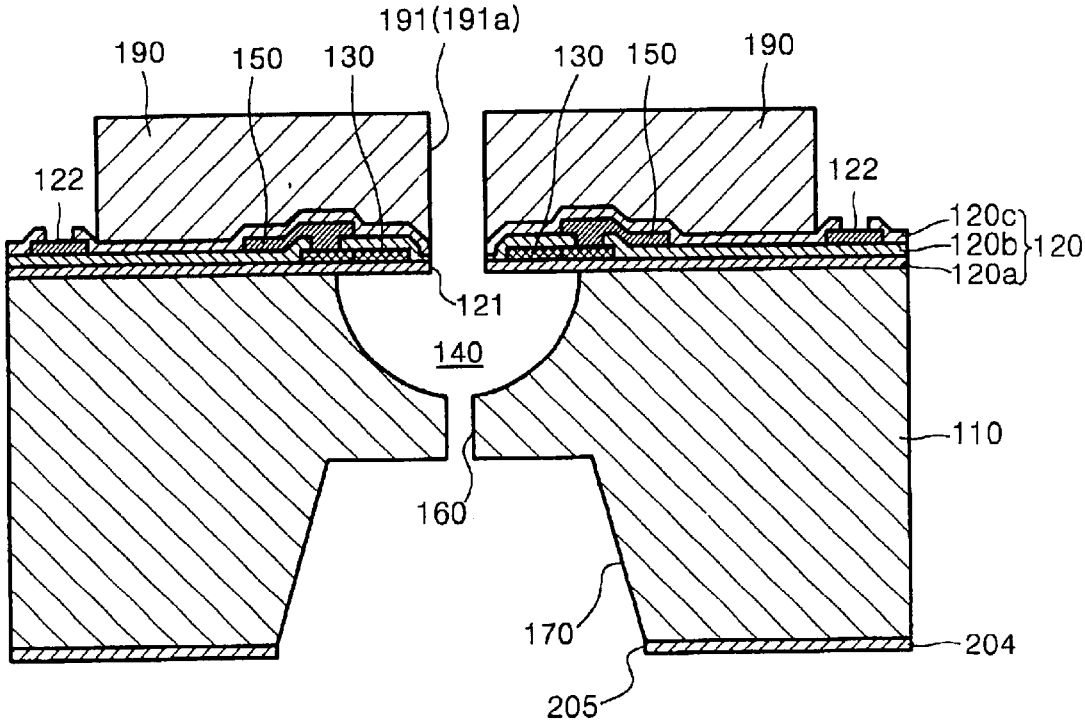

Finally, the ink passage 160 having a diameter of about 25 microns is formed by dry etching on the bottom of the ink chamber 140, as shown in FIG. 3M.

As described above, the nozzle plate is protected using photoresist having a proper hydrophobic property, and the droplet guide is created therefrom. In the above structure according to the present invention, in which the photoresist is hydrophobic, wetting of the surface of the nozzle plate by ink may be prevented. In addition, in the presence of the droplet guide, leakage of bubbles generated in the ink chamber may be prevented, and in particular, when droplets are consecutively ejected through the droplet guide with bubbles, the meniscus of ink may be rapidly stabilized. This enables the ink to be smoothly supplied to the ink chamber and rapidly ejected through the droplet guide. In addition, a bubble guide whose formation requires an additional process is removed, and thus a desired ink-jet printhead may be manufactured by a simpler process than the prior art.

According to the present invention, the droplet guide instead of the bubble guide is formed from the coating layer, and thus an additional process is not required. In addition, the coating layer is formed of the negative-type photoresist and thus, light curing of the coating layer when it is exposed to ultraviolet rays during manufacturing and further during use, enhances its resistance to abrasion and chemicals.

Further, a tapered droplet guide having a conical shape may be formed by properly adjusting exposure conditions of the photoresist of the coating layer when patterning the droplet guide. With the tapered droplet guide, the speed, frequency, and precision with which ink droplets are ejected may be improved. Since the coating layer is formed to a sufficient thickness on the nozzle plate, an irregular profile caused by the stack structure of the insulating layers under the coating layer is removed by planarizing the coating layer.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An ink-jet printhead, comprising:

an ink chamber;

a substrate on which the ink chamber is formed;

a nozzle plate to cover the ink chamber, having a nozzle formed in the ink chamber through which ink droplets are ejected from the ink chamber, and formed of a multi-layer insulating layer;

a heater buried in the nozzle plate to surround the nozzle;

an interconnection layer buried in the nozzle plate to electrically connect to the heater; and a coating layer formed of photoresist on the nozzle plate, the coating layer and the nozzle plate providing a through hole-type droplet guide connected to the nozzle of the nozzle plate to guide the ejected ink droplets.

2. The ink-let printhead of claim 1, wherein the coating layer is formed of a negative-type photoresist to increase a mechanical intensity of the coating layer.

3. The ink-jet printhead of claim 1, wherein the coating layer is thicker than the nozzle plate.

4. The ink-jet printhead of claim 3, wherein the droplet guide formed through the coating layer is a tapered droplet guide whose diameter gradually decreases in a direction in which the ink droplets are ejected.

5. The ink-jet printhead of claim 4, wherein the tapered droplet guide is formed by adjusting exposure conditions of the photoresist of the coating layer during a patterning process of the droplet guide.

6. The ink-jet printhead of claim 1, wherein the ink chamber is a hemispherical shaped ink chamber formed in a top surface of the substrate, and an entrance of the nozzle formed through the nozzle plate is flush with a ceiling of the ink chamber.

7. The ink-jet printhead of claim 1, further comprising:

an ink passage formed on a bottom surface of the ink chamber; and a rectangular channel-type manifold formed under the ink chamber, wherein ink is supplied to the ink chamber from the manifold via the ink passage.

8. The ink-jet printhead of claim 1, wherein the multi-layer insulating layer includes a first, second, and third insulating layer.

9. The ink-jet printhead of claim 8, wherein the heater is formed between the first insulating layer and the second insulating layer to surround the nozzle.

10. The ink-jet printhead of claim 9, wherein the interconnection layer is formed between the second insulating layer and the third insulating layer.

11. The ink-jet printhead of claim 8, wherein the third insulating layer includes a plurality of insulating layers, at least one of the plurality of layers being a passivation layer.

12. The ink-jet printhead of claim 11, wherein the coating layer is formed on the third insulating layer.

13. The ink-jet printhead of claim 1, wherein the nozzle plate is protected by using the photoresist and the through hole-type droplet guide is formed therefrom, allowing a meniscus of ink to stabilize when the ink droplets are ejected.

* * * * *

UNITED STATES PATENT AND TRADEMARK OFFICE

CERTIFICATE OF CORRECTION

PATENT NO. : 6,880,919 B2
DATED : April 19, 2005
INVENTOR(S) : Jae-sik Min et al.

It is certified that error appears in the above-identified patent and that said Letters Patent is hereby corrected as shown below:

Title page,
Item [54], Title, change "OF" to -- FOR --.

Column 8,
Line 19, change "ink let" to -- ink-jet --.

Signed and Sealed this

Third Day of January, 2006

JON W. DUDAS
*Director of the United States Patent and Trademark Office*